United States Patent [19]

Ogura

[11] 4,098,214

[45] Jul. 4, 1978

[54] FLOAT MADE OF AN AUTOMOBILE-TIRE

[75] Inventor: Shoni Ogura, Tokyo, Japan

[73] Assignee: Kanazawa Tsusho Sangyo Kabushiki Kaisha, Tokyo, Japan

[21] Appl. No.: 732,990

[22] Filed: Oct. 15, 1976

[30] Foreign Application Priority Data

Mar. 26, 1976 [JP] Japan ..... 51-33145

[51] Int. Cl.[2] ..... B63C 9/04

[52] U.S. Cl. ..... 114/267; 114/230; 9/8 R

[58] Field of Search ..... 9/400, 8 R, 9; 114/68, 114/69, 230; 104/123; 301/63 DS; 152/310

[56] References Cited

U.S. PATENT DOCUMENTS

| | | | |
|---|---|---|---|
| 2,088,430 | 7/1937 | Nelles | 104/123 |
| 2,945,468 | 7/1960 | Payne | 9/8 R |
| 3,382,009 | 5/1968 | Hawley | 301/63 DS |
| 3,694,837 | 10/1972 | Von Norring | 9/8 R |
| 3,728,749 | 4/1973 | Eby | 9/8 R |
| 3,866,652 | 2/1975 | Ahmad | 152/310 |

*Primary Examiner*—Trygve M. Blix
*Assistant Examiner*—D. W. Keen
*Attorney, Agent, or Firm*—Oldham, Oldham, Hudak & Weber Co.

[57] ABSTRACT

A float device of particularly low cost, having a wide range of application. It utilizes a waste tire with a mass of foamed resin or other porous material filled therein to form an annular float and includes a body structure secured to the float in closely fitting relation thereto and provided centrally with hook means to enable cable or rope connection of the device to an anchor or a hurdle or raft for fishery use. The body structure also has an annular disc portion on which a light device as an aid to navigation or other object can be stably mounted, as required.

2 Claims, 8 Drawing Figures

FLOAT MADE OF AN AUTOMOBILE-TIRE

BACKGROUND OF THE INVENTION

This invention relates generally to float devices such as those used to keep afloat mooring, lighted or other buoys intended as aids to navigation and those used to suspend in the water hurdles for fish raising or rafts for shellfish planting. Such float devices conventionally include a hollow body or a mass or porous material such as foamed synthetic resin material.

On the other hand, road vehicles, widely employed in everyday traffic and transporation, have their wheels fitted with hollow pneumatic tires, which must be replaced by new ones after a definite period of use. This apparently results in waste tires occurring day by day in large quantities, involving difficulties in their disposal.

SUMMARY OF THE INVENTION

Under this situation, the present invention is designed to reutilize waste tires as a material for float devices with the intention of alleviating the problem of waste tire disposal and saving industrial resources and has for its object the provision of a novel float device which is of particularly low cost, utilizing a waste tire, and usable not only as a float of navigational aids or buoys but also as float means for suspending fishery-farming hurdles or rafts in the water.

A specific object of the present invention is to provide a float device which utilizes a waste tire and includes a flat disc formation on which a signal light for navigational use or any other object can be mounted in a stable state, as required.

Another object of the present invention is to provide a float device of the character described which includes hook means enabling not only connection of an anchoring cable to the device in cases where it is used as a mooring buoy but also the tying to the device of a rope for suspending a farming hurdle or raft in the water.

According to the present invention, there is provided a float device which comprises: an annular float formed of a waste hollow tire of rubber filled with a porous material, such as a foamed synthetic resin material, to give a buoyancy large enough to keep the whole device afloat on the surface; a body structure having a flat disc portion on which a navigational aid, such as a signal light device or an electric signal transmitter, or other object can be mounted, as required, and a flanged peripheral portion adapted to be secured to the annular float is closely fitting relation thereto like the rim of an automotive wheel; and hook means provided on the disc portion of the body structure in the center thereof to enable cable or rope connection with ease and efficiency. When used as a navigational aid, the float device can be held fixed at any desired location by connecting an anchored rope or cable to the hook means.

It is to be understood that the device of the present invention can also serve as a float for fish-raising or clam-planting use with a rope for suspending a hurdle or raft in the water tied to the hook of the device.

The above and other objects, features and advantages of the present invention will become apparent from the following description when taken in conjunction with the accompanying drawings.

DESCRIPTION OF THE PREFERRED EMBODIMENTS

Figure 1:
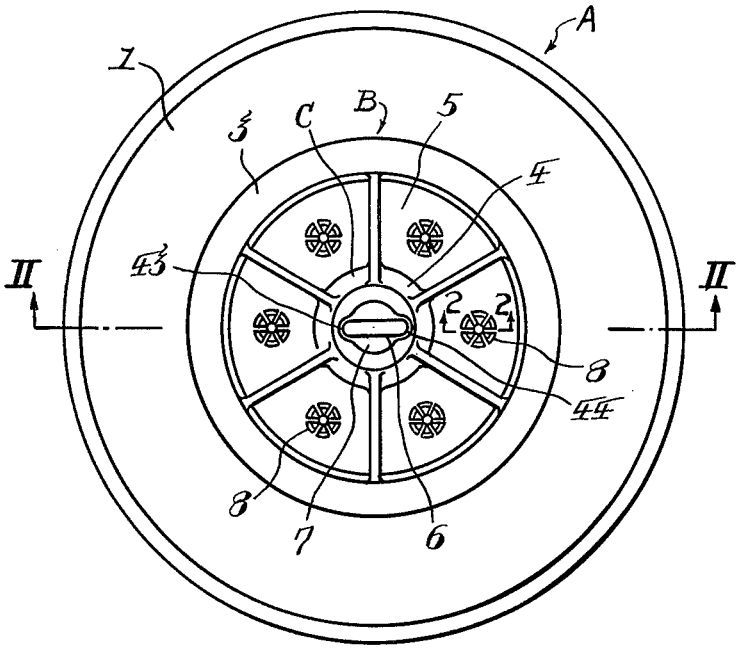
FIG. 1 is a plan view of a preferred form of float device embodying the present invention.
Figure 2:
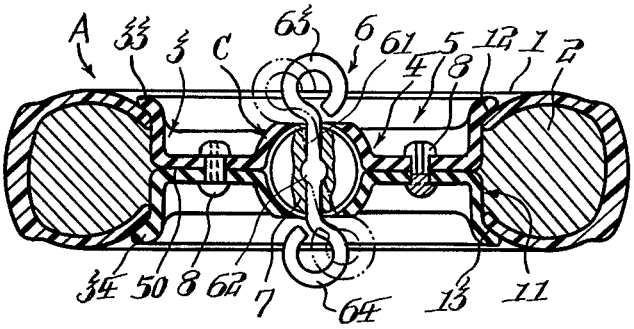
FIG. 2 is a vertical cross section of same taken along the line II — II in FIG. 1.

Referring to the drawings and first to FIGS. 1 and 2, the float device illustrated includes, as generally indicated at A, an annular float comprised of a waste hollow tire of rubber, 1, serving as a casing and a mass of porous material, e.g., of closed-cell foamed polyurethane resin, 2, filled in the hollow of the casing tire 1.

Figure 3:
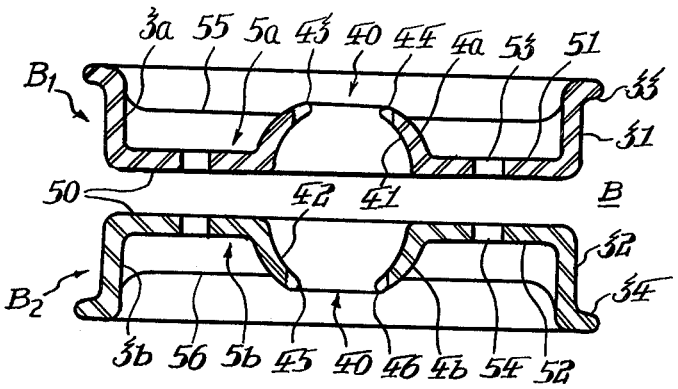
FIG. 3 is an exploded view, in vertical cross section, illustrating on a slightly enlarged scale the body structure of the float device shown in FIGS. 1 and 2.
Figure 4:
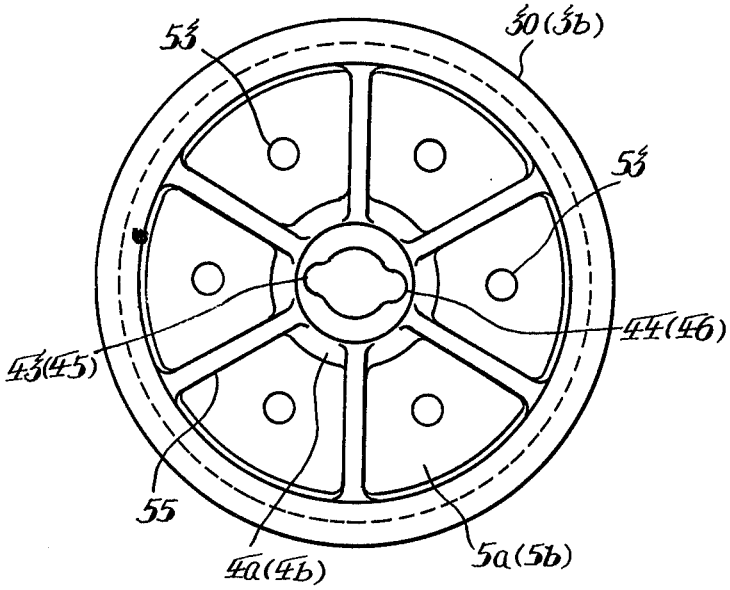
FIG. 4 is a plan view of the body structure, drawn to the same scale as FIG. 3.

As generally indicated at B, the float device also includes a body structure which is of split form, consisting of a pair of upper and lower dished body halves of identical configuration. As shown in FIGS. 3 and 4 on a slightly enlarged scale, the upper body half $B_1$ has an annular flange portion **3*a* formed around the periphery thereof and generally extending vertically upward. Similarly, the lower body half $B_2$ has an annular flange portion 3*b* formed around the periphery thereof and generally extending vertically downward. As seen in FIG. 2, the annular flange portions 3*a* and 3*b***, respectively, of the upper and lower body halves $B_1$ and $B_2$, together form a rim-like flange portion of the body structure B.

The above described body structure B, two halves of which are designed as cup or dish like shapes enables to hold safety on the disc portion **5*a*** of upper body half, the mounted articles as a flashing type signal light device, or a signal wave transmitter or others.

Referring again to FIG. 3, both the two dished members of the body structure or the upper and lower body halves $B_1$ and $B_2$ have a hemispherical raised ball-receiving portion **4*a* or 4*b* formed in the center on the same side as the peripheral flange 3a or 3b. The raised ball-receiving portions 4*a* and 4*b* on the two body halves $B_1$ and $B_2$ jointly form a ball retainer means in the center of the body structure, as generally indicated at 4 in FIGS. 1 and 2. The upper body half $B_1$ has an annular web portion 5*a* which extends radially between the peripheral flange portion 3*a* and the central protrusion or raised ball-receiving portion 4*a* and which is formed integral with these portions. Similarly, the lower body half $B_2$ has an annular web portion 5*b* which extends radially between the peripheral flange 3*b* and central ball-receiving protrusion 4*b***.

The two dished members $B_1$ and $B_2$ of the body structure B each have a flat bottom surface 50 defined by the annular web portion **5*a* or 5*b*** for close abutting engagement with each other.

The peripheral flange portions **3*a* and 3*b*, formed on the respective body halves $B_1$ and $B_2$, have each a cylindrical outer surface 31 or 32 of a diameter corresponding to that of the inner periphery of casing tire 1 of the annular float A and also have each an annular radially bent edge 33 or 34 formed a grip the adjacent one of the inner peripheral edge portions 12 and 13 of the casing tire 1**.

As clearly seen in FIG. 2, the upper and lower body halves $B_1$ and $B_2$ construced in the manner described can serve the purpose of sealingly closing the radially inwardly directed annular opening 11 defined in the casing tire 1 between the edge portions 12 and 13 thereof.

Figure 5:
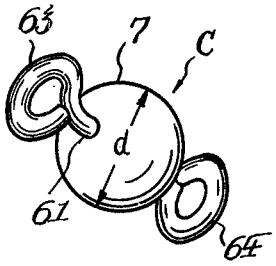
FIG. 5 is an oblique view of the hook means, drawn to the same scale as FIG. 3.

The ball-receiving raised portion 4*a* or 4*b* of each of the upper and lower body halves $B_1$ and $B_2$ has an interior, bearing surface 41 or 42 coinciding with the lateral surface of a lightly truncated hemisphere the base surface of which lies in the plane of the bottom surface 50 of the body half $B_1$ or $B_2$. That is, the raised ball-receiving portions 4*a* and 4*b* of the body halves $B_1$ and $B_2$ are each in the form of a hollow hemisphere having an open base and a top opening 40 (FIG. 3) and, in combination, form a generally spherical ball retainer 4, as shown in FIG. 2. The ball retainer 4 formed in this manner has circular top and bottom openings 40 and a nearly spherical internal bearing wall surface of an appropriate diameter slightly larger than that, *d*, of a global member 7 of hook means C, which will be described later in detail with reference to FIG. 5. The peripheral edge of the upper half 4*a* of ball retainer 4, which defines top opening 40, is slotted in positions diametrally opposite to each other to form a pair of notches 43 and 44 each shaped substantially semicircular. Similarly, the peripheral edge of the lower half 4*b* of ball retainer 4, which defines end opening 40, is formed with a pair of diametrally opposite notches 45 and 46.

The web portion 5*a* of the upper half of body structure B takes the form of a flat annular disc 51 which interconnects the peripheral flange portion 3*a* and central ball-receiving portion 4*a* and whose under surface forms the bottom surface 50 of the upper body half $B_1$ for close abutting engagement with the corresponding surface of the lower body half $B_2$ and is formed with a plurality of rivet holes 53 in circular arrangement, as clearly seen in FIG. 4. The annular web portion 5*a* of the upper body half $B_1$ is also formed with a plurality of reinforcing ribs 55 which extend radially from the outer peripheral surface of the central ball-receiving portion 4*a* to the inner peripheral surface of the annular flange portion 3*a*. Similarly, the annular web portion 5*b* of lower body half $B_2$ is formed with a plurality of rivet holes 54 aligned with the respective rivet holes 53 in the annular web portion 5*a* of upper body half $B_1$ and a plurality of reinforcing ribs 56 similar to those, 55, formed on the upper body half $B_1$. As seen in FIGS. 1 and 2, the annular web portions 5*a* and 5*b* are firmly joined by rivets 8 to form an integral disc portion 5 of the body structure B, on which a light device as an aid to navigation or any other object can be mounted as required.

The upper and lower halves $B_1$ and $B_2$ of the body structure B are of quite the same configuration and, including flange portion 3*a* or 3*b*, ball-receiving portion 4*a* or 4*b* and 4*b* and annular web portion 5*a* or 5*b*, can each be formed integrally of an appropriate synthetic resin material by injection molding.

As observed clearly in FIG. 2, the hook means C includes a hook member 6 in the form of a rod of rust-free metal, 61, having looped opposite ends 63, 64 and an enlarged intermediate portion 62, and a global body of synthetic resin material, 7, cast around the hook member 6 as by injection molding. As shown, the hook member 6 extends through the global body 7 along the axis thereof and is firmly held against axial movement relative thereto with the enlarged intermediate portion 62 fixed in the center of global body 7.

In forming the float device, including, as described, annular float A, body structure B and hook means C, initially a mass of porous material 2 is packed into the annular hollow space in the rubber tire 1, which is a waste tire. Then, the upper and lower halves $B_1$ and $B_2$ of body structure B are fitted into the central opening of the tire 1 from above and below, respectively, with their abutting surfaces 50 directed toward each other, while holding the global body 7 of hook means C between the upper and lower body halves $B_1$ and $B_2$ with the opposite hooks or looped end portions 63 and 64 of hook member 6 directed into the ball-receiving portions 4*a* and 4*b*, respectively, of the body halves $B_1$ and $B_2$. As the body halves $B_1$ and $B_2$ are moved close to each other, the hooks 63 and 64, entering the respective ball-receiving portions 4*a* 4*b*, pass through the end openings 40 to appear above and below the respective ball-receiving portions 4*a* and 4*b* owing to the pairs of aligned notches 43 – 44 and 45 – 46, which are formed, as deseribed above, in the annular edges of the respective openings 40 and permit such passage of hooks 63 and 64 therethrough. Finally, when the abutting surfaces 50 of the upper and lower halves of the body structure B are brought into close contacting engagement with each other, as shown in FIG. 2, the global body 7 of hook means C is restrained in a spherical space defined by the inner bearing wall surfaces 41 and 42 of respective ball-receiving portions 4*a* and 4*b*, which jointly form a ball retainer 4. The hook member 6 and integral global body 7 thus restrained in the ball retainer 4 are freely rotatable about the axis thereof and also oscillatable within certain limits, as indicated by the chain-dotted lines in FIG. 2, because of the inner diameter of the ball retainer 4, which is slightly larger than the diameter of global body 7, and because of the diameter of the end openings 40, which is larger than that of hook rod 61.

In the state of the two body halves $B_1$ and $B_2$ held together in the manner described, the annular flange portions 3*a* and 3*b*, with their outer cylindrical surfaces 31 and 32 aligned with each other, cooperate to sealingly close the casing or tire 1 of annular float A around the inner periphery thereof, the bent edges 33 and 34 of the respective annular flanges 3*a* and 3*b* grippingly engaging the respective inner peripheral edge portions 12 and 13 of tire 1 so that the annular float A is firmly secured to the body structure B around the periphery thereof and there is no danger that the float A be dislodged or inadvertently removed from the body structure B.

Figure 6:
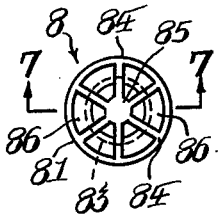
FIG. 6 is a plan view showing, to a further enlarged scale, one of the rivets used on the body structure.
Figure 7:
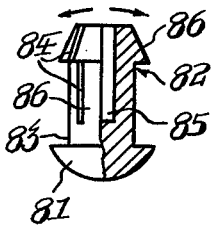
FIG. 7 is a side elevational view of the rivet, the right-hand half showing same in cross section along the line VII — VII of FIG. 6.

Reference will next be made to FIGS. 6 and 7, which illustrate, on an enlarged scale, the form of rivets 8 used to join the upper and lower halves of the body structure B with each other into an integral unit. As observed, the rivet 8 is constituted of a shank portion 83 having a diameter substantially equal to that of rivet holes 53 and 54 formed in the disc portion 5 of the body structure B and a thickness equal to that of the disc portion 5, which corresponds to the sum of the thicknesses of the respective disc components 51 and 52, a substantially hemispherical head portion 81 formed at one end of the shank 83, and a frustoconical head portion 82 formed at the other shank end. Formed in the rivet 8 is an axial bore 85 which extends through the frustoconical head portion 82 and partly into the shank portion 83. Also, radial slits 84 are formed in the rivet to divide the frustoconical head portion 82 and an adjacent shank portion into six equal segments 86. As observed in FIG. 7, the axial bore 75 and radial slits 84 extend axially to the vicinity of the hemispherical head portion 81, which is larger in diameter than the frustoconical head portion 82, and the segments 86 each carrying a division of the latter head portion 82 are radially freely deflectable, as indicated by the arrows in FIG. 7.

In use of the rivet 8, its frustoconical head portion 82 is pushed into the associated aligned rivet holes 53 and 54 in the upper and lower body halves $B_1$ and $B_2$, which are held together in aligned back-to-back contacting relation, as shown in FIG. 2. The frustoconical head 82 of the rivet 8 as pushed into the rivet holes 53 and 54 is forcefully reduced in diameter against its own resiliency and, upon passing through the rivet holes 53 and 54, restores its original size and shape on the underside of the disc portion 5, as shown. As the result, the disc components or annular web portions 5*a* and 5*b* of upper and lower body halves $B_1$ and $B_2$ are firmly joined together and an integral unit of body structure B is formed on the annular float A to complete the float device. The mass of porous material filled in the tire or casing of the annular float A, including numerous foams of air, exhibits a buoyancy enough to keep the entire float device afloat on the surface of water.

The porous material as a filling material used in the casing tire may be of water-absorbing, spongy structure so long as it is self-holding enough to maintain the size and shape of the tire, only if the rim or flange portion 3 of body structure B is of a structure designed to airtightly seal the open edge of the tire around the inner periphery thereof. Use, however, of a porous material of the closed-cell type of structure, e.g., a closed-cell foamed polyurethane resin material, is advantageous in that, with the tire filled with such material, there is no loss of buoyancy even if water be allowed to enter the space within the tire to soak the porous material. Where the porous material used is a pourable, expandable resin material, such material can conveniently be poured into the hollow of the casting tire after the float device has been assembled with no porous material filled in the tire.

Figure 8:
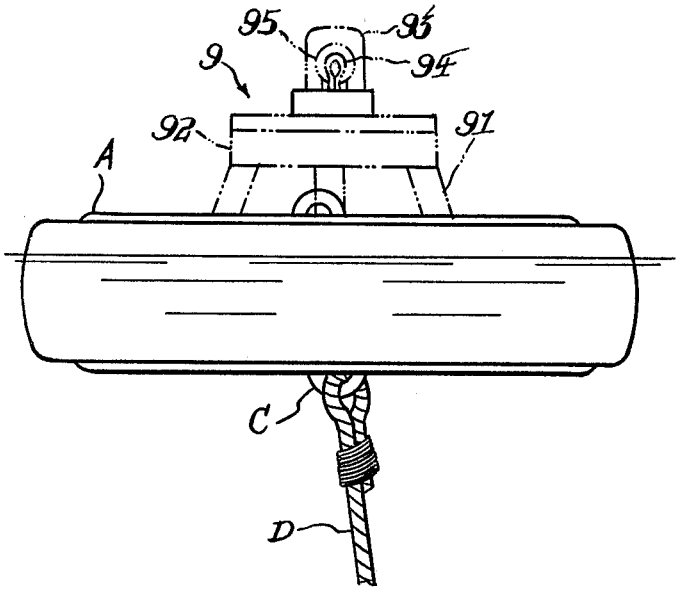
FIG. 8 is a side elevation of a lighted buoy employing a float device of the present invention.

FIG. 8 illustrates an example of use of the float device of the present invention, in which the device serves as a float member of a lighted buoy. In this figure, reference numeral 9 generally indicates a flashing type signal light device mounted on the body structure of the float device by pedestal means. The light device 9 is generally of conventional structure, including a body unit 92, supported on the pedestal 91 and combined with a source of electric power supply. Mounted on the body unit 92 are an electric lamp bulb 94 and a rotary reflecting mirror device 95 which are enclosed in a transparemt cover 93. When the float device is thus used, the level of floor, i.e., disc portion 5, which supports mounted articles is kept lower than the water surface, so that it should maintain the security of mounted articles in case the float device is shaken by the sea waves. The lighted buoy can be anchored at any desired location by use of an appropriate anchoring cable D, which is fastened at one end to an anchor, not shown. As illustrated, the anchoring cable D is fastened at the other end to the buoy by threading the cable end through the bottom loop of hook means C and firmly tying it to the latter.

The float device of the present invention is also utilizable as a float for a radio buoy by mounting a battery type signal wave transmitter on the body structure B of the device in place of the signal light 9. Further, the device may be used as a float for shell-fish planting rafts to be suspended in the water because of the provision of hook means C, which makes it possible to tie any form of raft to the device with ease and efficiency.

It will be apparent to those skilled in the art that the range of application of the float device of the present invention is not limited to the examples shown or stated herein and that, though one preferred embodiment of the invention has been specifically shown and described, many changes and modifications may be made therein without departing from the spirit of the invention or the scope of the appended claims.

What is claimed is:

1. A float device comprising: an annular float (A) consisting of a casing (1) made of a pneumatic tire which has inner peripheral opening (11) defined between the peripheral annular edge portions (12 and 13) thereof and a mass of porous material (2) filled in the annular hollow of said casing; a body structure (B) having an annular disc portion (5) and an annular flange portion (3) formed around the periphery of said disc portion (5) and generally extending vertically upward and downward and also have annular radially bent edges (33 and 34) therewith for sealing engagement with said peripheral annular edge portions (12 and 13) and said inner peripheral opening (11) therebetween; and hook means (C) provided on said body structure from rope connection;

said body structure (B) being of split form, including an upper body half ($B_1$) and a lower body half ($B_2$) joined with each other, said upper body half ($B_1$) including an annular upper disc portion (5*a*), an annular flange portion (3*a*) formed around the periphery of said upper disc portion (5*a*) and generally extending vertically upward and having an annular radially bent edge (33) thereon, said lower body half ($B_2$) including an annular lower disc portion (5*b*), an annular flange portion (3*b*) formed around the periphery of said lower disc portion (5*b*) and generally extending vertically downward and having an annular radially bent edge (34) thereon; and in which said hook means (C) provided on said body structure (B) extends through both of the central portions of said upper and lower disc portions (5*a*, 5*b*) therethrough; and said upper and lower disc portions (5*a*, 5*b*) having hollow hemispherically raised ball-receiving portions (4*a*, 4*b*) formed in the central portion on the same side as said flange portions (3*a*, 3*b*) and having a top opening (40) therein; and in which said hook means (C) comprises a hook member (6) of rust-free metal material and a global body (7) formed thereon integrally therewith, said ball receiving portions (4*a*, 4*b*) of said two body halves corresponding to form a ball retainer 4 to hold said global body (7) of said hook means (C) and swingably support said hook member (6) by said two body halves ($B_1$and $B_2$) as secured.

2. A float device as claimed in claim 1 in which said two body halves ($B_1$ and $B_2$) of said body structure (B) are of quite the same configuration and joined together by means of rivet holes (53 and 54) formed correspondingly in said two web portions (5*a* and 5*b*) of said body structure (B) and rivets engaging said rivet holes (53 and 54) and extending therethrough.

* * * * *

UNITED STATES PATENT OFFICE

CERTIFICATE OF CORRECTION

PATENT NO. : 4,098,214

DATED : July 4, 1978

INVENTOR(S) : Shoni Ogura

It is certified that error appears in the above-identified patent and that said Letters Patent are hereby corrected as shown below:

Column 1, line 51, "is" should be -- in --

Column 3, line 4, "a" should be -- to --

Column 3, line 8, "construced" should be -- constructed --

Column 4, line 22, "4a4b" should be -- 4a and 4b --

Column 5, line 58, "sparemt" should be -- sparent --

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*